United States Patent [19]

Falwell et al.

[11] Patent Number: 4,710,992

[45] Date of Patent: Dec. 8, 1987

[54] WATERBED RAIL CAP

[76] Inventors: Bobby R. Falwell, Rte. 7, Box 696, Murray, Ky. 42071; Orval H. Wooley, 7301 Annie La., Paducah, Ky. 42001

[21] Appl. No.: 45,447

[22] Filed: May 1, 1987

[51] Int. Cl.[4] ..... A47C 21/00

[52] U.S. Cl. ..... 5/508; 5/424; 24/545; 248/345.1

[58] Field of Search ..... 5/508, 451, 424, 93 R; 248/345.1; 24/545

[56] References Cited

U.S. PATENT DOCUMENTS

| | | | |
|---|---|---|---|
| 4,089,497 | 5/1978 | Miller et al. | 248/345.1 |
| 4,109,887 | 8/1978 | Wakeland, Jr. | 5/451 |
| 4,554,039 | 11/1985 | James | 5/508 |

*Primary Examiner*—Alexander Grosz

*Attorney, Agent, or Firm*—Mark J. Patterson

[57] ABSTRACT

A padded bedrail cap can be folded and flattened during installation. Spring clips are provided to form a channel within the cap during installation. The bedrail cap is friction fit over the bedrail.

3 Claims, 8 Drawing Figures

WATERBED RAIL CAP

BACKGROUND OF THE INVENTION

The present invention relates to a padded cap for use on the side or front rails of a waterbed frame.

Although waterbeds have become increasingly popular and sophisticated in their design, most still use a conventionally designed wooden frame to contain the water filled mattress. Campian, U.S. Pat. No. 4,625,351, describes one example of such a frame. A well-recognized problem with the typical waterbed frame is that the wooden rails are uncomfortable for the user while sitting or while entering or exiting the bed. In addition, a standard wooden rail has no means of securing the vertical sections of the waterbed mattress liner which are usually installed between the mattress and the frame box. Consequently, a variety of slip-on padded rail caps have been developed to address these problems. Examples are described by Fisher, U.S. Pat. No. 4,514,871; James, U.S. Pat. No. 4,554,039; Wakeland, U.S. Pat. No. 4,109,887; and Johenning, U.S. Pat. No. 4,197,602.

However, most padded rail caps for waterbeds are sold as accessories to the bed itself, to be installed after the bed is erected and a liner placed. Padded rails previously known and used have been manufactured as one-piece rigid units with a preformed channel which friction-fits over the rail. These designs have several drawbacks. First, they are bulky and therefore expensive to ship and store. Second, their ability to maintain a tight grip on the rail and liner is reduced relatively quickly with use, because of deformation of the channel. Finally, because the tension which produces the friction-fit between the cap channel and exterior of the bed rail runs the full length of the rail, the tension produced at any one point is variable, causing premature wear and possible failure of the top edge of the liner. These problems are further aggravated by the variation in rail thicknesses that are now being sold.

What is needed, then, is a padded rail cap that remains flat and can be folded during shipment and storage and that can retain firm tension when used on rails of varying thickness without causing undue wear of the rail or mattress liner.

SUMMARY OF THE INVENTION

In the present invention, a piece of bedrail-length compressible foam material is covered with fabric or vinyl, leaving lengthwise cylinders on each lengthwise edge to receive wooden dowels. A dowels is inserted into each cylinder, leaving a slight gap in the middle of the cylinders, so that the cap may be folded during shipment and storage. Spring clips are provided and installed by the customer to engage the dowels at openings through the covering over the dowel cylinders, thereby forming a channel for surrounding and engaging the upper horizontal and vertical bedrail surfaces. The spring clips are fitted with hooks which removably engage and secure the dowel.

An object of the present invention, then, is to provide a padded bedrail cap that can be shipped and stored in a folded and flattened position.

A further object of the present invention is to provide a quick and efficient means by which the user can form a channel in the rail cap and secure the rail cap to the bedrails of varying thickness.

DESCRIPTION OF THE PREFERRED EMBODIMENT

Figure 1:
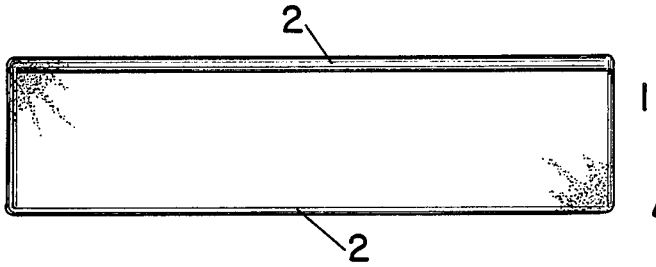
FIGS. 1, 2, 3, and 4 are top, side, end, and perspective views, respectively, of the folded rail cap prior to installation of the spring clips.
Figure 2:
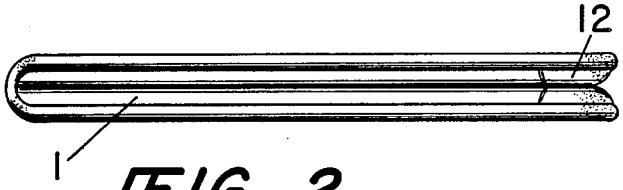
Figure 3:
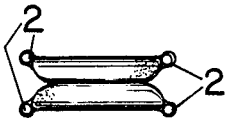
Figure 4:
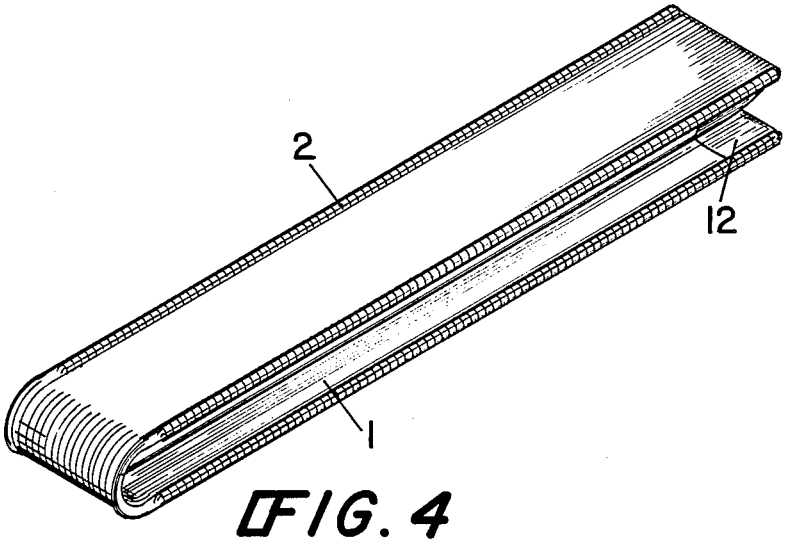
Figure 5:
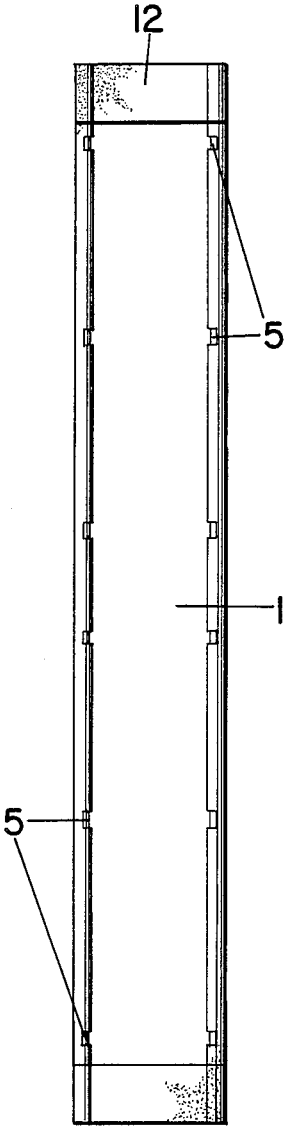
FIGS. 5 is a bottom view of the unfolded rail cap prior to installation of the spring clips.

As best seen in FIGS. 1 and 5, a piece of flexible and compressible foam material 1 is covered at its top and around its edges with a vinyl or fabric cover 12 which is folded and secured on the bottom surface of material 1. Sufficient loose fabric is left along the lengthwise outer edges of material 1 to form cylinders 2. The length of material 1 is selected to approximately match the length of any standard waterbed side rail. The width of material 1 is such that, when curved around the rail, it will cover the top of and approximately six inches down each side of the rail, as seen on FIG. 7. Rigid structural members, such as dowels 3, which are approximately but not quite one-half the length of material 1, are inserted within cylinders 2 to provide rigidity for the cap. When inserted, a small gap is left by dowels 3 in the middle of each cylinder 2 such that the cap can be folded at its center as seen in FIGS. 1 through 4. Slots 5 are provided in the cover along cylinders 2 for attachment of spring clips 6 during installation.

Figure 8:
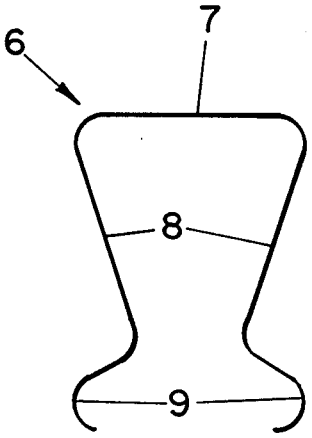
FIG. 8 is an enlarged view of the spring clip.

Spring clips 6 are shipped with, but not initially installed in the cap. Spring clips 6 are preferably made of spring steel or other durable spring-like material and preferably shaped as best seen on FIG. 8, with horizontal section 7, angled sections 8, and dowel hooks 9.

Figure 6:
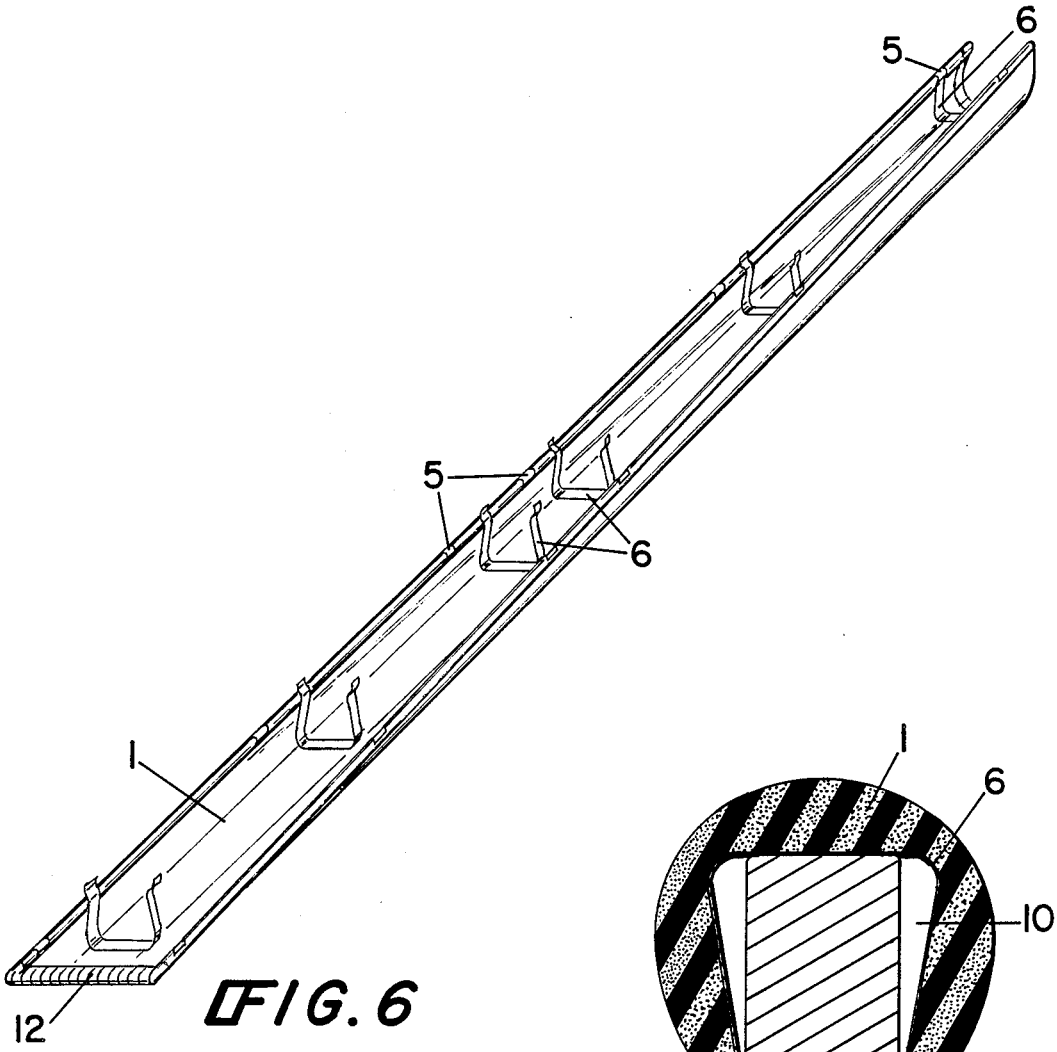
FIG. 6 is a perspective view of the rail cap with spring clips partially installed.
Figure 7:
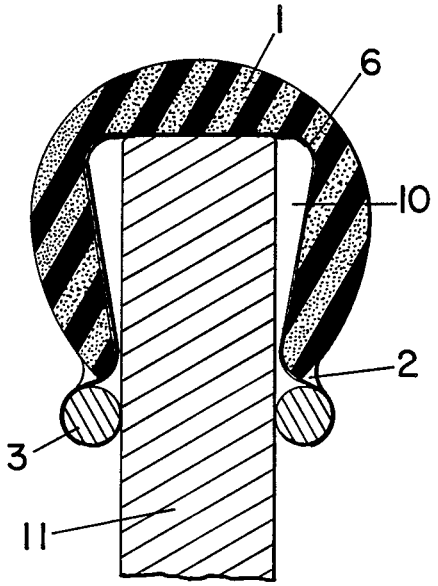
FIG. 7 is an enlarged end view of the rail cap as installed, with a partial cutaway end view of the bedrail.

When the cap is ready for installation, it is unfolded to its full length as seen in FIGS. 5 and 6. Spring clips 6 are then positioned along the lower surface of material 1 with horizontal section 7 of each spring clip 6 in contact with said lower surface of material 1. The lengthwise edges of the cap are manually folded up and around angled sections 8, and dowel hooks 9 are placed through cover slots 5 to engage the outermost portion of dowels 3, as best seen in FIGS. 6 and 7. After installation of each spring clip 6, the cap is thereby formed and secured around clips 6, forming interior channel 10. The open ends of spring clips 6 will typically be approximately one inch in width before installation. When the cap is placed over bedrail 11 as shown in FIG. 7, which bedrails are ordinarily manufactured having widths in excess of one inch, spring clips 6 are under tension and, through dowels 3, apply sufficient force against rail 11 to secure the cap and mattress liner (not shown) against rail 11. Therefore, the cap is adapted for use with rails of varying thickness and can be easily removed and installed without permanent relaxation or deformation of channel 10 as is seen in the prior art. In addition, wear along the uppermost vertical surfaces of rail 11 and/or mattress liner is minimized, because there is no contact with the cap except through dowels 3 and along the horizontal surface of rail 11.

It should be noted that the shapes of spring clips 6 and channel 10 can vary from those shown, and such shapes are within the scope of the present invention, as long as said clip is adapted for forming a channel which engages rail 11 and has means for removably attaching said clip to the rail cap.

What we claim are:

1. A rail cap for use on bedrails comprising:

a. a piece of foam or similarly flexible compressible padded material adapted to match and approximately cover the length and uppermost surfaces of a bedrail;

b. a cover mounted along the top surface of said foam material which cover is folded around the peripheral edges and secured to the lower surface of said foam material;

c. cylinders formed by and within the lengthwise outermost portions of said cover, said cylinders adapted for receiving a rigid structural member;

d. rigid structural members inserted within said cylinders leaving a gap in the center of each such cylinder such that said foam material and cover can be folded at their midpoint; and e. a plurality of spaced apart spring clip means for forming said foam material and cover into a channel which slidably friction fits over said bedrail.

2. The rail cap of claim 1 where said spring clip means removably engages said rigid structural members though slots in said cylinders of said cover.

3. The rail cap of claim 1 where said spring clip means are adapted to form said channel such that when slidably installed on said bedrail, contact is made only at the top horizontal bedrail surface and through said structural rigid members.

* * * * *